United States Patent [19]

Spence et al.

[11] 4,077,437

[45] Mar. 7, 1978

[54] APPARATUS FOR FORMING A DOUBLE CATCH THREAD NARROW WEAVE

[75] Inventors: Junior C. Spence, Stuart; Robert J. Rorrer, Woolwine; James L. Holt, Stuart, all of Va.

[73] Assignee: J. P. Stevens Co., Inc., New York, N.Y.

[21] Appl. No.: 737,625

[22] Filed: Nov. 1, 1976

Related U.S. Application Data

[62] Division of Ser. No. 527,438, Nov. 26, 1974, Pat. No. 4,004,617.

[51] Int. Cl.[2] ..... D03D 49/50; D03D 35/00

[52] U.S. Cl. ..... 139/116; 139/22

[58] Field of Search ..... 139/116, 118, 20, 22, 139/54, 383 R, 416–418, 440, 421

[56] References Cited

U.S. PATENT DOCUMENTS

| | | | |
|---|---|---|---|
| 3,308,855 | 3/1967 | Power et al. | 139/116 |
| 3,749,139 | 7/1973 | Rath | 139/116 |

FOREIGN PATENT DOCUMENTS

| | | | |
|---|---|---|---|
| 279,247 | 10/1914 | Germany | 139/116 |
| 256,390 | 8/1926 | United Kingdom | 139/117 |
| 1,187 of | 1876 | United Kingdom | 139/117 |
| 1,027 of | 1880 | United Kingdom | 139/117 |

*Primary Examiner*—James Kee Chi

*Attorney, Agent, or Firm*—Leitner, Palan & Martin

[57] ABSTRACT

A double catch thread weaving apparatus including two double index dobbies, the first of which controls the basic weave of the fabric and the second of which controls a pair of slackner heddles for the two catch threads. The timing of the second dobby is offset with respect to the timing of the first dobby and the shuttle cycle to pay a sufficient amount of catch thread to obtain an edge pattern using the shuttle thread and one of the catch threads at a time.

10 Claims, 27 Drawing Figures

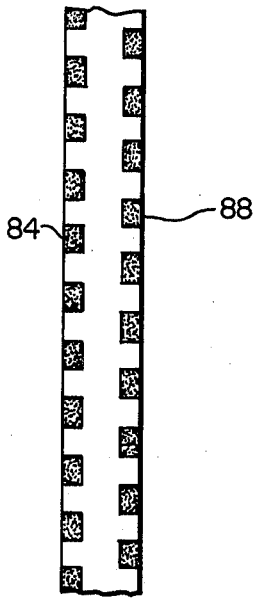
FIG. 15
FIG. 2
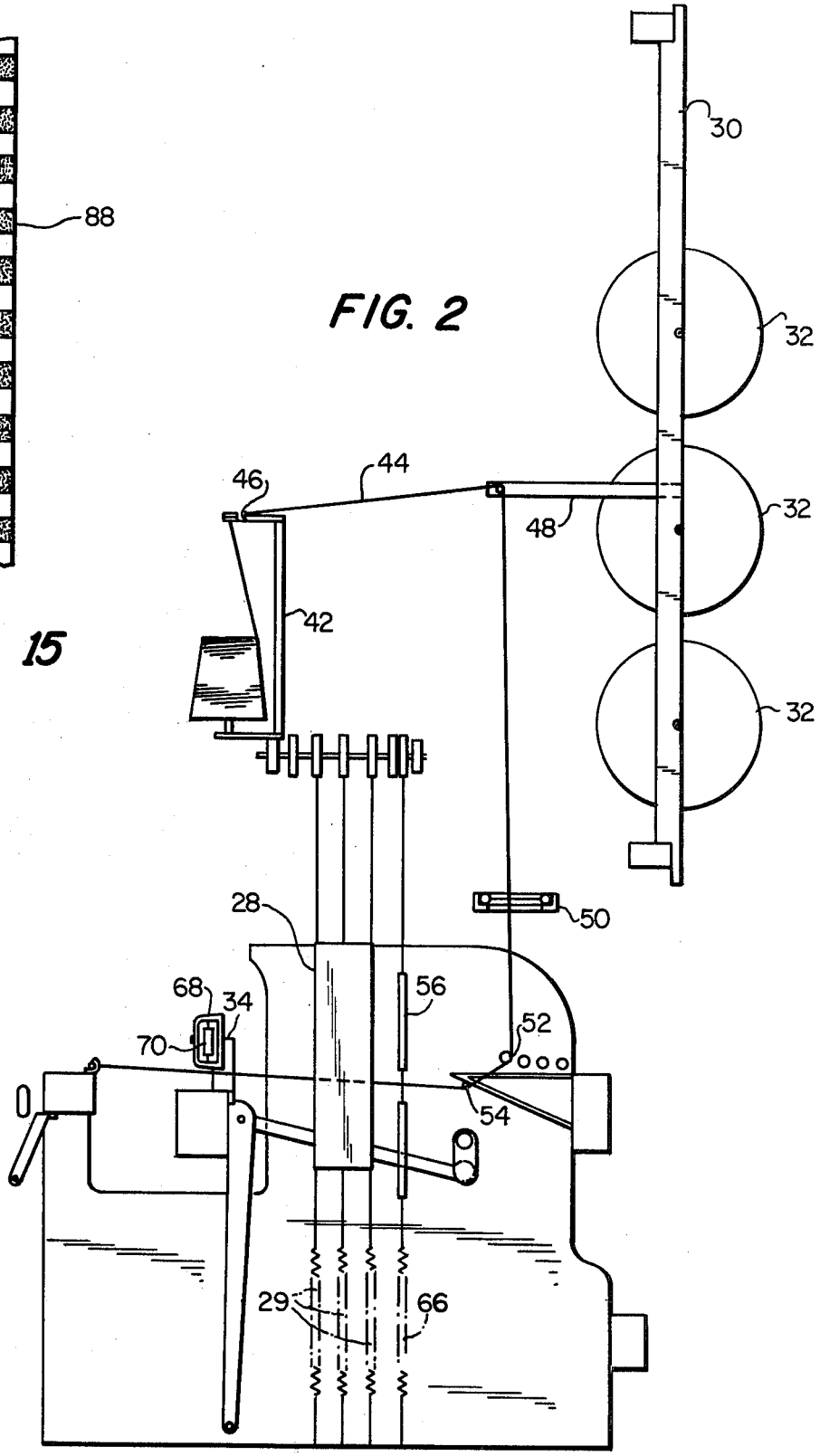

FIG. 14A
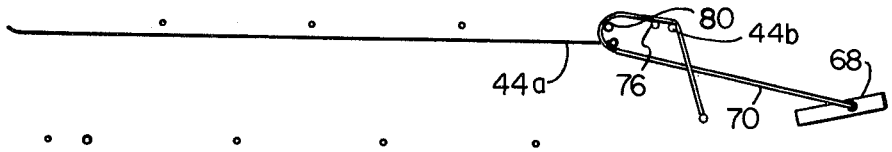
FIG. 14B
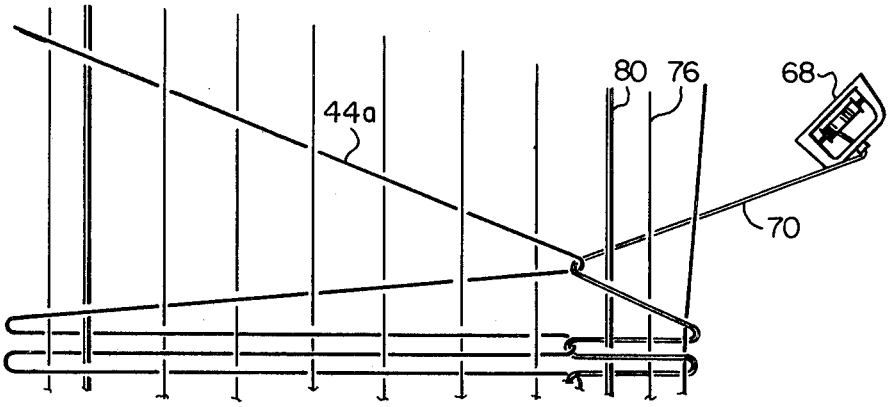
FIG. 16
| PICKS | DOBBY 24 | | | DOBBY 26 | |
|---|---|---|---|---|---|
| | MAIN WARP THREADS 72 | RIGHT EDGE WARP THREADS 76 | LEFT EDGE WARP THREADS 74 | CATCH THREAD NO. 1 44a | CATCH THREAD NO. 2 44b |
| 1 | | | o | | o |
| 2 | o | o | o | | |
| 3 | | | o | | o |
| 4 | o | o | o | | |
| 5 | | | o | | o |
| 6 | o | o | o | | |
| 7 | | | o | | o |
| 8 | o | o | o | | |
| 9 | o | o | o | | |
| 10 | | o | | o | |
| 11 | o | o | o | | |
| 12 | | o | | o | |
| 13 | o | o | o | | |
| 14 | | o | | o | |
| 15 | o | o | o | | |
| 16 | | o | | o | |
| 17 | o | o | o | | |

APPARATUS FOR FORMING A DOUBLE CATCH THREAD NARROW WEAVE

CROSS REFERENCE

This application is a divisional of application Ser. No. 527,438, filed Nov. 26, 1974, now U.S. Pat. No. 4,004,617.

BACKGROUND OF THE INVENTION

The present invention relates generally to an apparatus and method for weaving and, more particularly, to an apparatus and method for weaving edge patterns in a narrow elastic fabric.

In the field of narrow woven fabrics, it has been frequently desirable to produce a fabric having an alternating color design along its edge. In order to produce such a fabric, it has been necessary to dye yarns with alternating colors along fixed lengths of the yarn. These yarns were then utilized as the filling thread along the edge of a fabric. While this process was successful in producing the desired patterns, the process was extremely costly.

It is also known that a fabric may be woven by drawing a single catch thread across the warp with a shuttle thread. Such a system is shown in U.S. Pat. No. 671,820. It is further known that various patterns may be woven into the interior portions of a fabric. Such a technique is taught in U.S. Pat. No. 3,749,139. However, to date, no one has been able to weave an alternating color pattern into the edge of a fabric.

SUMMARY OF THE INVENTION

The present invention provides a weaving apparatus for weaving a narrow fabric having a plurality of warp threads interwoven with a pair of catch threads and a shuttle thread. The weaving apparatus includes a first shed change means for raising and lowering the warp threads periodically at a first set of points in time and a second shed change means for raising and lowering a single catch thread periodically at a second set of points in time. The second set of points is offset in time from the first set of points to determine the amount of pay of the catch thread.

The apparatus produces a woven fabric having a plurality of warp threads and a shuttle thread forming a predetermined number of first loops about a first edge of the warp threads. The shuttle thread further extends across the warp threads in an interwoven fashion and then forms a predetermined number of second loops about a second edge of the warp threads.

The apparatus of the present invention is controlled in such a manner as to provide a plurality of warp threads to form a first edge warp, a main warp and a second edge warp; to provide a first catch thread along a first edge of the first edge warp; and to provide a second catch thread along a second edge of the second edge warp. The apparaus is further controlled so as to loop a shuttle thread around the first catch thread, to draw the first catch thread through the warp threads, and to loop the shuttle thread around the warp threads of the second edge warp. After forming a predetermined plurality of loops in this manner, the apparatus is controlled further in such a manner as to weave the shuttle thread across the warp; to loop the shuttle thread around the second catch thread; draw the second catch thread through the warp threads and loop the shuttle thread around the warp threads of the first edge warp.

OBJECT OF THE INVENTION

An object of the present invention is the provision of an apparatus for weaving a narrow elastic fabric which is capable of weaving various edge patterns into the fabric.

Another object of the present invention is the provision of an apparatus for weaving various edge patterns into a narrow fabric in a relatively simple and inexpensive manner.

A further object of the present invention is the provision of an apparatus for weaving various edge patterns into a narrow fabric, which apparatus requires that only a small amount of modifications be made to existing weaving apparatuses.

Still another object of the present invention is the provision of a narrow woven fabric having various edge patterns woven therein, which fabric is relatively inexpensive to manufacture.

A still further object of the present invention is the provision of a method for controlling a weaving apparatus so as to enable one to obtain any desired edge pattern on the fabric.

Other objects, advantages and novel features of the present invention will become apparent from the following detailed description of the invention when considered in conjunction with accompanying drawings.

BRIEF DESCRIPTION OF THE DRAWINGS

FIG. 2 shows a side view in diagrammatic form of the weaving apparatus of the present invention;

FIGS. 4A–14A illustrate in schematic form an end view of a step-by-step breakdown of the process of the present invention;

FIGS. 4B–14B illustrate in schematic form a top view of FIGS. 4A–14A;

FIG. 15 illustrates a typical fabric embodying the principles of the present invention;

FIG. 16 illustrates a control program for the apparatus of the invention for producing a weave such as that illustrated in FIG. 3.

DESCRIPTION OF THE PREFERRED EMBODIMENTS

Figure 1:
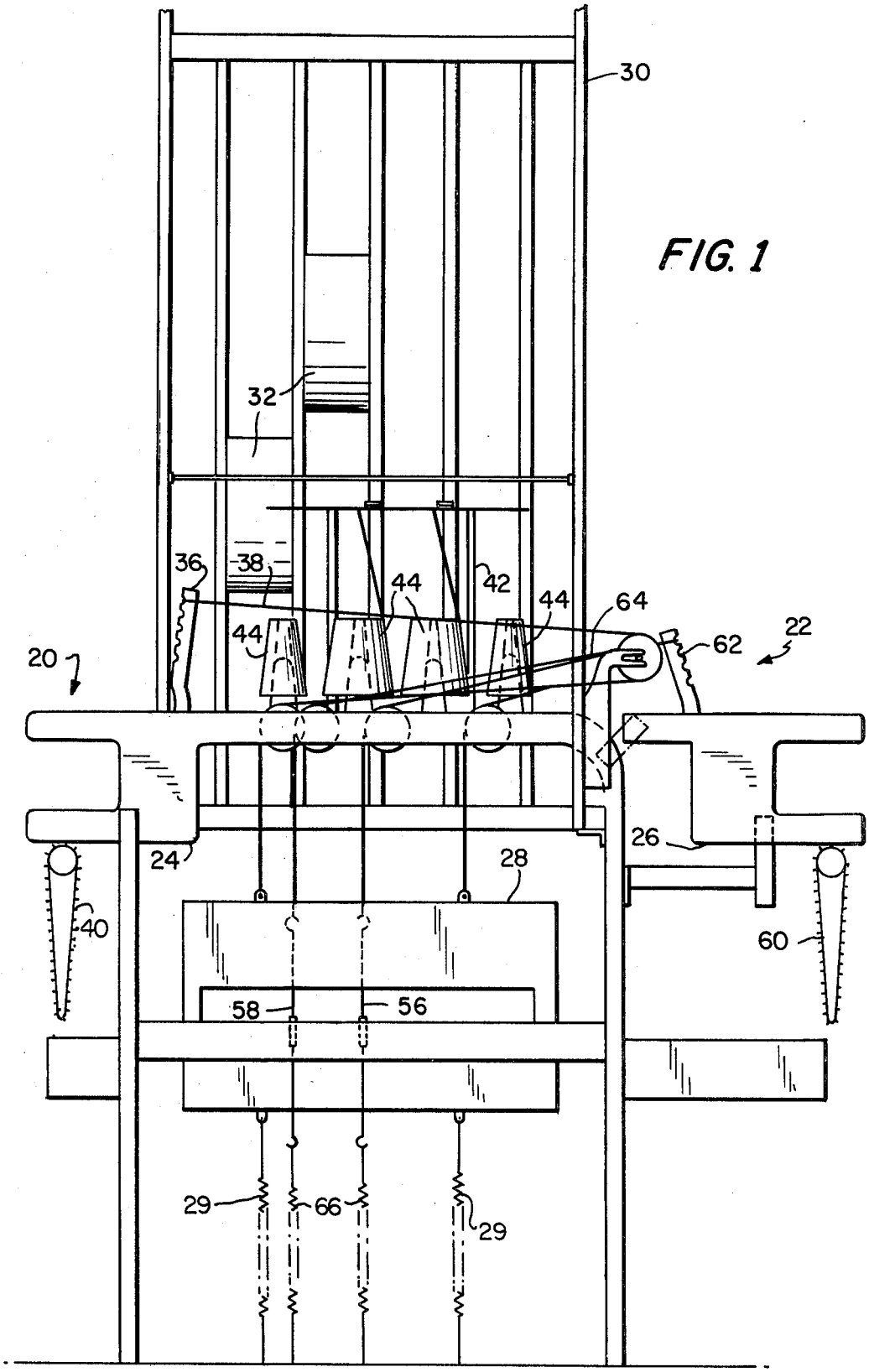
FIG. 1 shows a front view in diagrammatic form of the weaving apparatus of the present invention.

Referring to FIGS. 1 and 2, the apparatus of the present invention will be described in detail. FIG. 1 illustrates diagrammatically a front view of the weaving apparatus of the present invention. FIG. 2 shows a side view of the weaving apparatus of the present invention.

The present invention preferably employs a shuttle loom having a first shed change means 20 and second shed change means 22. The shed change means 20 and 22 preferably include two double index dobbies 24 and 26, respectively. It is to be understood that it is within the skill of one of ordinary skill in the art to design an equivalent weaving apparatus employing chain heads instead of dobbies 24 and 26. The first dobby 24 is the main dobby and is utilized to control a plurality of harnesses, generally indicated at 28. The harnesses 28 are hooked by means of springs 29 to a floor mounting. The weaving apparatus of the present invention includes a standard back rack 30 upon which are mounted a plurality of warp beams 32. The threads from the warp beams 32 are fed through the harnesses 28 and through a reed holder 34 in a conventional manner. The reed holder 34 includes a front reed (not shown) for separating the warp threads. The main dobby 24 includes a plurality of jack levers 36 which are connected to harness frames 28 by means of a plurality of lifter cords 38. The main dobby 24 is controlled by a double index dobby bar 40 which determines the pattern of the warp threads in a known manner.

A filling holder 42 is mounted on the top of the loop frame. A plurality of cones of filling yarn 44 are held in place by the filling holder 42. For the purposes of the present invention, at least two cones of filling yarn 44 are required and these cones provide the catch threads to be utilized in weaving the novel fabric of the present invention. The catch threads 44 are fed first through a disc-type tension device 46 mounted on the filling holder 42. The catch threads 44 are then fed through a feeder rod 48 mounted on back rack 30, through a back reed 50, under a whip roll 52 and then under an adjustable feeder rod 54. From the feeder rod 54, the catch threads 44 are fed through a pair of slackner heddles 56 and 58 and then through harness 28 and the reed holder 34.

The second dobby 26 is utilized to shed the catch threads 44 in accordance with the pattern control transmitted to it by the double index dobby bar 60. The dobby 26 is equipped with a plurality of jack levers 62 which are connected by means of lifter cords 64 to the slackner heddles 56 and 58. It should be understood that harnesses could be substituted for slackner heddles 56 and 58 without departing from the spirit of the present invention. The slackner heddles 56 and 58 are hooked by means of springs 66 to a floor mounting. Heddles 56 and 58 are positioned to be aligned with each edge of the fabric. The loom is further equipped with a shuttle quill 68 having a spool of shuttle thread 70 mounted thereon.

A particularly critical feature of the present invention is that the timing of second dobby 26 is offset from that of main dobby 24 and the shuttle quill 68. The degree of such offset timing is dependent on the width of the particular fabric being woven. The importance of such offset timing will become evident in the discussion of the operation of the weaving apparatus of the present invention. Most double index dobbies include a sprocket drive gear which is linked by means of a chain to a drive motor. In order to obtain the degree of offset timing desired, one need merely loosen the chain on the sprocket drive gear of dobby 26, advance the sprocket drive gear to achieve the desired amount of offset timing and then tighten the chain.

Figure 3:
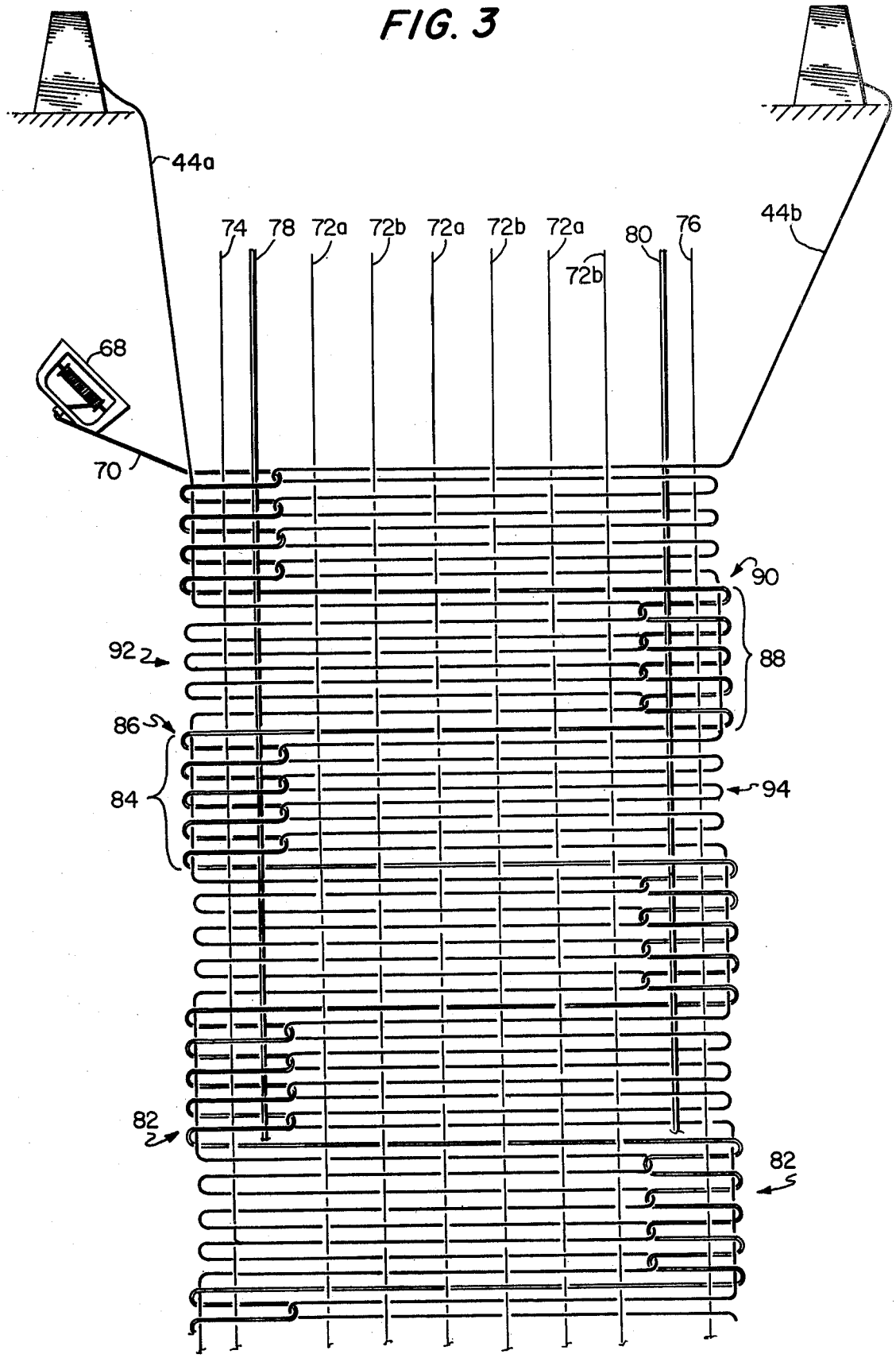
FIG. 3 shows in schematic form a woven fabric embodying the principles of the present invention.

FIG. 3 shows, in schematic form, a fabric being woven by the apparatus of the present invention. A plurality of main warp threads 72 are provided from warp beams 32 to comprise the main portion of the warp of the woven fabric. In addition, first edge warp threads 74 are provided at a first edge of said main warp and second edge warp threads 76 are provided at a second edge of said main warp, also from the warp beams 32. In the preferred embodiment of the present invention, warp threads 72, 74 and 76 are elastic threads. A wire 78 is inserted into the fabric and held by the loom between the main warps 72 and the first edge warp 74. A second wire 80 is inserted into the fabric and held by the loom between the main warps 72 and the second edge warp 76. In practice, wires 78 and 80 are inserted approximately 6 inches into the woven fabric in order to lend rigidity to the edge of the warp. As fabric is woven, it gradually slides off the ends of the wires as shown at 82. The particular pattern woven into the main warp of the fabric does not in any way limit the implementation of the present invention and, as a result, for purposes of illustration in FIGS. 3 and 4A, B through 14A, B, a very elementary pattern has been illustrated schematically. It is to be understood that the warp threads 72 are merely representative of an unlimited number of threads and warp patterns and likewise the edge warp threads 74 and 76 located on the first and second edges of the warp are representative of any number of warp threads and patterns that one may choose to select.

As illustrated in FIG. 3, the shuttle thread 70 forms a predetermined number of first loops 84 about edge warp threads 74 on the first edge of the warp. The shuttle thread 70 then extends across the warp threads in an interwoven fashion as shown at 86 and then forms a predetermined number of second loops 88 about edge warp threads 76 on the second edge of the warp. The shuttle thread 70 then extends across the warp 72 in an interwoven fashion as shown at 90. This configuration of a predetermined number of shuttle thread loops on one edge of the fabric, an interwoven crossover to the second edge of the fabric, and a predetermined number of second loops along the second edge of the fabric, is repeated for the entire length of the fabric desired. It is to be understood that while the fabric illustrated schematically in FIG. 3 employs five loops 84 on a first edge of the fabric and five loops 88 on a second edge of the fabric, that this is shown by way of illustration only and that the particular number of loops to be utilized with any given fabric is a matter of choice with the designer of the fabric pattern.

The first catch thread **44*a* extends across the fabric in an interwoven fashion as illustrated at 92 and loops around the second shuttle thread loops 88. In a like manner, the second catch thread 44*b* extends across the fabric in an interwoven fashion, as illustrated at 94, and loops around the first shuttle thread loops 84. The shuttle thread 70 and the catch threads 44*a* and 44*b*** are preferably of different colors so that a fabric may be woven which has an alternating color pattern along each of the edges.

Figure 4A:
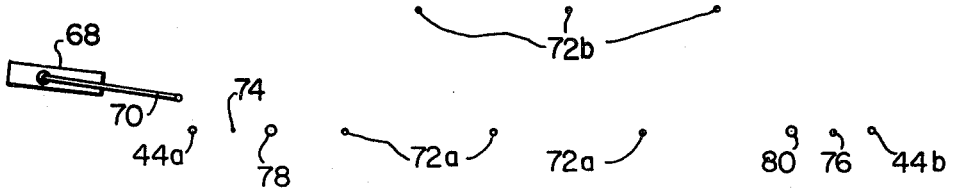
Figure 4B:
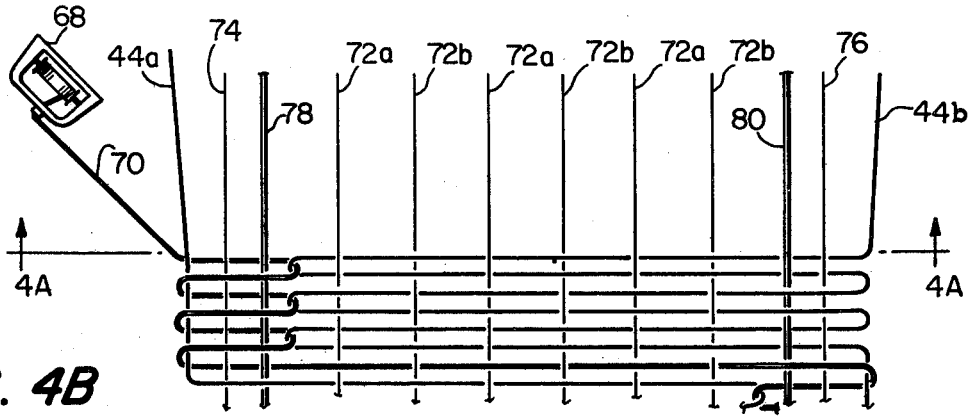

The method of weaving the double catch thread weave of the present invention will now be described in connection with FIGS. 4A,B–14A,B. FIGS. 4A through 14A show sectional end views of the warp and weaving action, with the section being taken immediately after the last completed shuttle loop. FIGS. 4B through 14B show top views of the weaving action as it is depcited in FIGS. 4A through 14A. FIGS. 4A and B shows the shuttle 68, the shuttle threads 70, the catch threads **44*a* and 44*b*, the main warp threads 72*a* and 72*b*, the edge warp threads 74 and 76, and the wires 78 and 80 in their respective positions at the start of a cycle. The shuttle 68 has just completed the third loop along the first edge of the warp and is about to begin the cycle that will create the fourth shuttle thread loop. The harnesses 28 have been controlled so that the main warp threads 72*a* are in their lower position and the main warp threads 72*b* are in their upper position. First and second edge warp threads 74 and 76 are in their lower position as are wires 78 and 80. The second catch thread 44*b* is in its lower position and the first catch thread 44*a* is illustrated as being in its lower position. The position of catch threads 44***a* and 44*b* are controlled by harness 28 and additionally heddles 56 and 58.

Figure 5A:
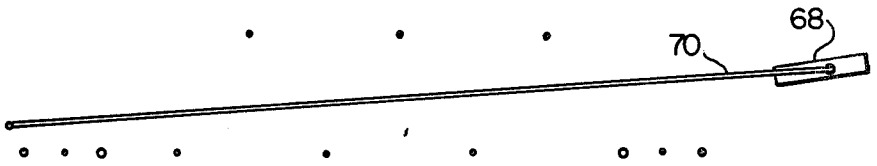
Figure 5B:
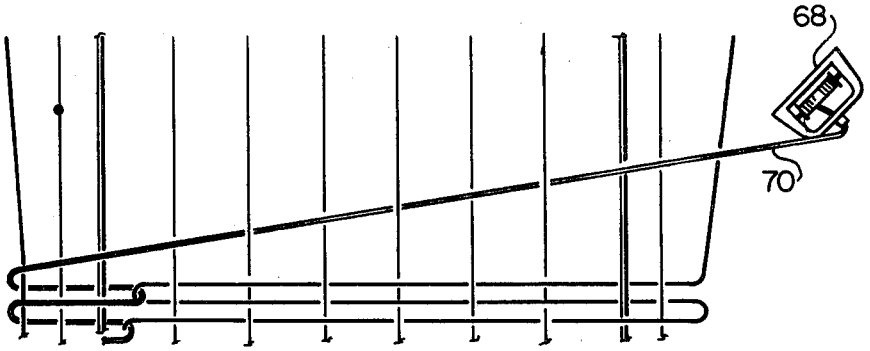

FIGS. 5A and B shows the apparatus after the shuttle 68 has passed through the warp pulling the shuttle thread 70 over warp threads 74, 72*a* and 76 and over wires 78 and 80 and catch threads 44*b*. At this point in the cycle, the shuttle 68 has not yet reached its extreme right position of travel. As the shuttle 68 moves from left to right, it is controlled to pay out shuttle thread 70 in response to tension on the shuttle thread 70, in a known manner.

Figure 6A:
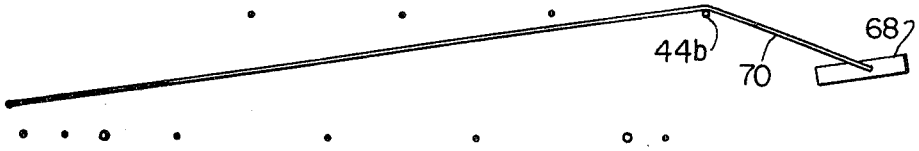
Figure 6B:
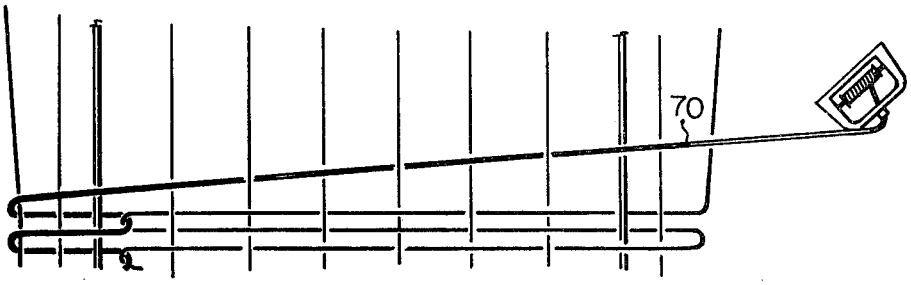

Before the extreme right position of travel is reached by shuttle 68 and after it has passed over the second catch thread 44*b*, the second catch thread 44*b* is moved by slackner heddle 56 and the dobby 26 in order to raise it to its upper position as illustrated in FIG. 6B. The moving of the second catch thread 44*b* causes additional catch thread to be payed off of cone 44 and allows the catch thread 44*b* to slacken on the downward movement of the slackner heddle 56. The timing of the raising of the catch thread 44*b* to pay out is critical to successful operation of the apparatus. Additional importance of the moving or shedding of the catch thread 44*b* at this point in the cycle will become apparent later in the discussion of the weaving process. It is important to emphasize at this point that it is essential that the catch thread 44*b* be moved after the shuttle 68 has passed it in its left to right travel and that the catch thread 44*b* reverses its motion before being caught by the shuttle thread. Thus, for narrow fabrics, a fairly wide range of offset timing, for example, 1° to 60°, would be acceptable. For a wider fabric, the acceptable range of offset timing would shrink, for example, from 1° to 30°.

Figure 7A:
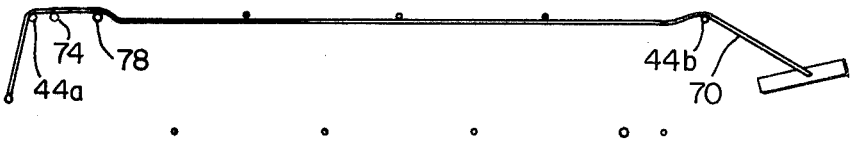
Figure 7B:
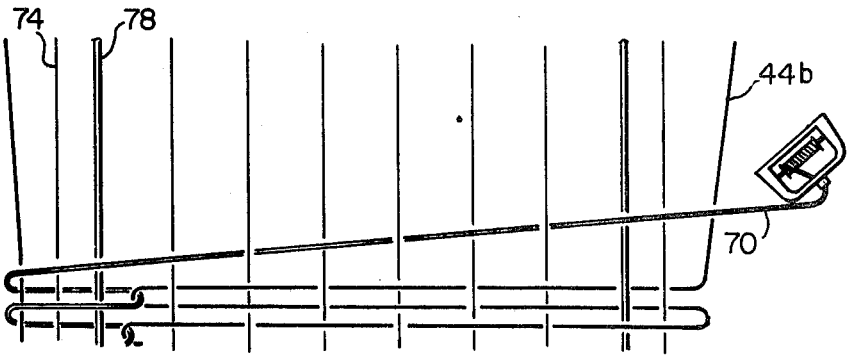

After the shuttle 68 reaches its right limit of travel as shown in FIGS. 7A and B, the appropriate harness 28 is moved by dobby 24 to raise the first edge warp threads 74, catch threads 44*a* and 44*b* and the wire 78 to their upper position and the cycle of the second dobby 26 is ended. If the edge warp threads 74 includes a plurality of warp threads, they are shedded or their positions are reversed to interweave and catch the shuttle thread 70.

Figure 8A:
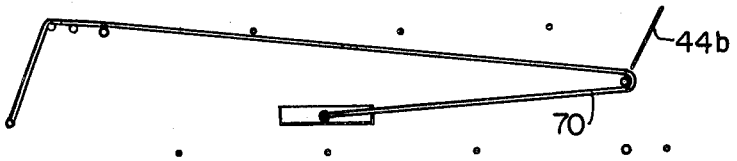
Figure 8B:
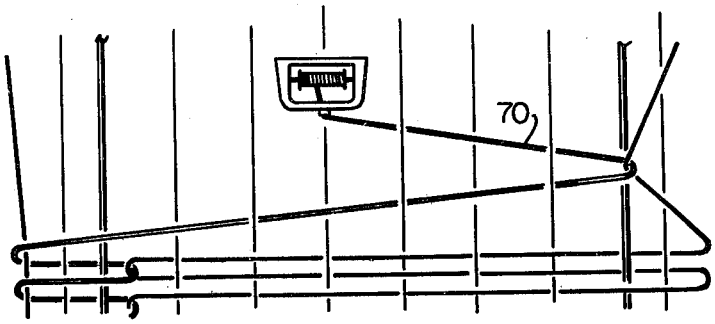
Figure 9A:
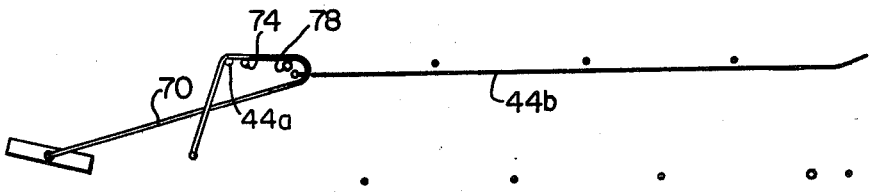
Figure 9B:
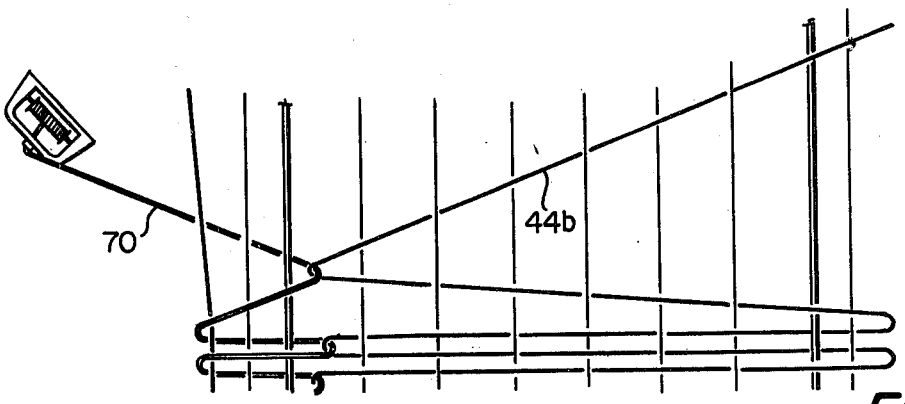
Figure 10A:
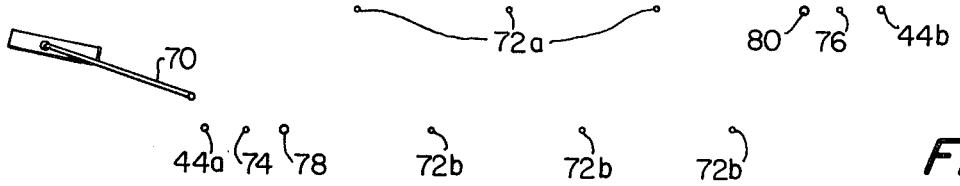
Figure 10B:
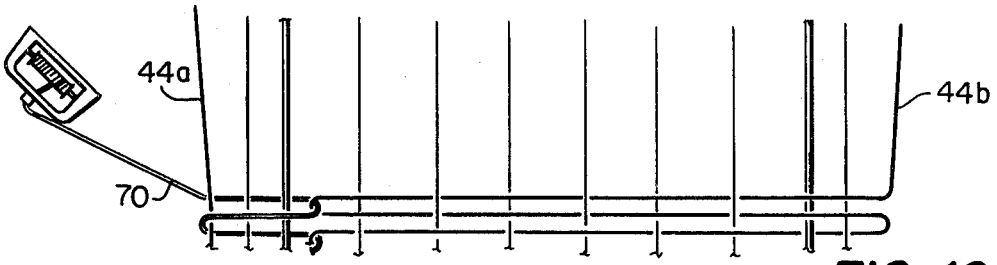

As shuttle 68 starts its leftward movement through the warp as shown in FIGS. 8A and B, it is controlled to clamp the shuttle thread 70 and, therefore, prevents the shuttle thread 70 from paying out. The shuttle 68 then passes under the second catch thread 44*b*, thus looping the shuttle thread 70 around the catch thread 44*b* and drawing catch thread 44*b* into the warp. FIGS. 9A and B shows the shuttle 68 after it has completed its leftward travel. At this point, shuttle thread 70 has passed under the first edge warp threads 74, catch thread 44*a* and the wire 78, thus creating the fourth loop in the sequence and has drawn the second catch thread 44*b* entirely across the warp and locked it in position against the wire 78 and the edge warp threads 74.

At this point in the cycle, the appropriate harnesses 28 are again actuated by dobby 24, raising the main warp threads 72*a*, wire 80 and the second edge warp threads 76 to their upper position and maintaning catch threads 44*b* in its upper position; at the same time lowering main warp threads 72*b*, catch threads 44*a*, wire 78 and first edge warp threads 74 to their lower position. It should be noted that the actuation of dobby 24 in actual practice may occur anytime after the shuttle 68 clears the weft threads. When this is accomplished, the reed holder 34 is actuated to move forward and comb the catch thread 44*b* and shuttle thread 70 into a tight weave with the previously woven fabric. After this combing operation has been accomplished, the weave is in the condition indicated in FIGS. 10A and B.

Theoretically, all the shuttle thread weft edge loops are uniform extending from the catch thread 44*a* to wire 78. But in actual weaving, it has been found that the inside edge is not always at the wire 78; it may be a couple or so warp threads to the right. The specific location of the inner loops depends on how far the shuttle thread 70 pulls the catch thread 44*b* before dobby 24 is actuated to reverse the shed. The imperfection arises from the uneven tensioning of catch thread 44*b* and the timing of the dobby 24 relative to the shuttle 68 and dobby 26. The present apparatus and method assures the location of the inner loop at the wire 78 by the offset timing of dobby 26 which initially overpays catch thread 44*b*. The tension on catch thread 44*b* is reduced by the overpay, which allows shuttle thread to properly locate the inner loop before dobby 24 reverses the shed. Since the catch thread 44*b* is moved up and down before the shed is reversed by the first dobby 24 to entrap the catch thread 44*b*, the amount of overpay of catch thread may be adjusted by adjusting the offset timing of the moving of the catch thread relative to the reversing of the shed in combination with the position of lifter cord 64 on jack levers 62.

Figure 11A:
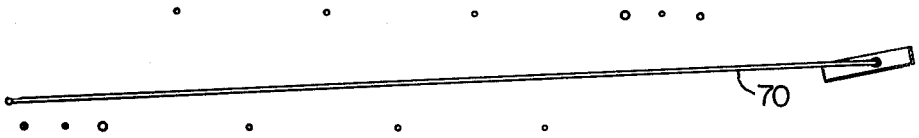
Figure 11B:
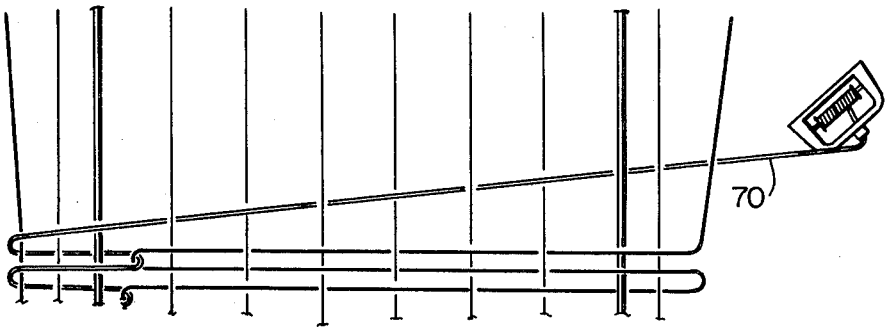
Figure 12A:
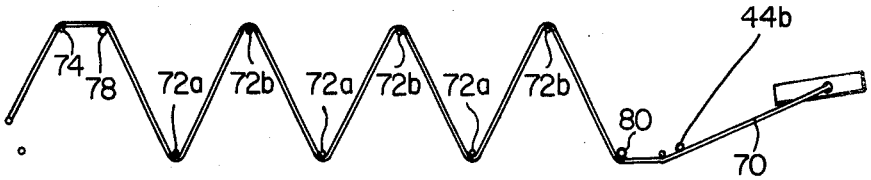
Figure 12B:
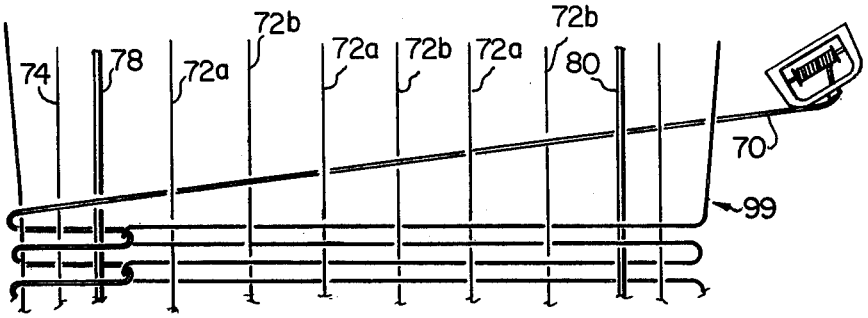

After the shuttle has completed one less than the predetermined number of first loops about the first edge warp threads 74, which in this case is four loops, shuttle 68 again passes through the warp is as shown in FIGS. 11A and B to form the fifth loop and start the cycle for the second edge. After the shuttle 68 has reached its right limit of travel as is shown in FIGS. 12A and B, the appropriate harnesses 28 are again lifted and lowered by dobby 24 to raise main warp threads 72*b*, first edge warp threads 74 and wire 78 to their upper position; and lower main warp threads 72*a*, second edge warp threads 76 and wire 80 to their lower position. This action has the effect of weaving shuttle thread 70 into the fabric as is shown in FIGS. 12A and B. It is important to note at this point in the cycle that the catch thread 44*b* is not entrapped in the weave. Thus, had the catch thread 44*b* not been pulled taut on the previous cycle (FIGS. 10 A and B), a slight loop or imperfection in the fabric may develop at point 99. Thus the full significance of the offset timing of dobby 26 now becomes apparent. Had the dobby 26 not paid out precisely the right amount of catch thread 44*b* on the previous cycle, catch thread 44*b* would not have been pulled taut and a defect in the fabric would have developed at 99. The offset timing on dobby 26 through the moving or shedding of catch thread 44*b* causes the right amount of catch thread 44*b* to pay out which in turn causes the catch thread 44*b* to be pulled taut by shuttle thread 70. Also, as is shown in pick 9 of FIG. 16, the catch thread 44*b* is not over payed at the crossover and thus is taut.

Figure 13A:
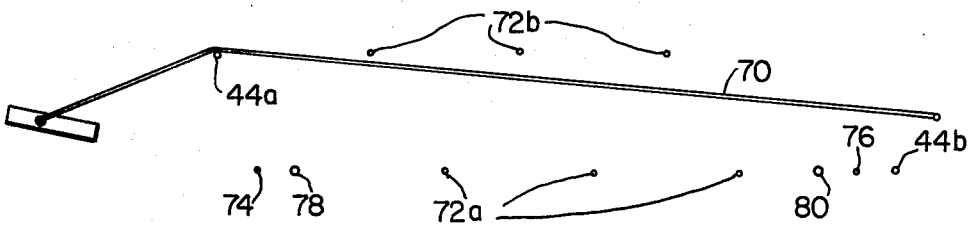
Figure 13B:
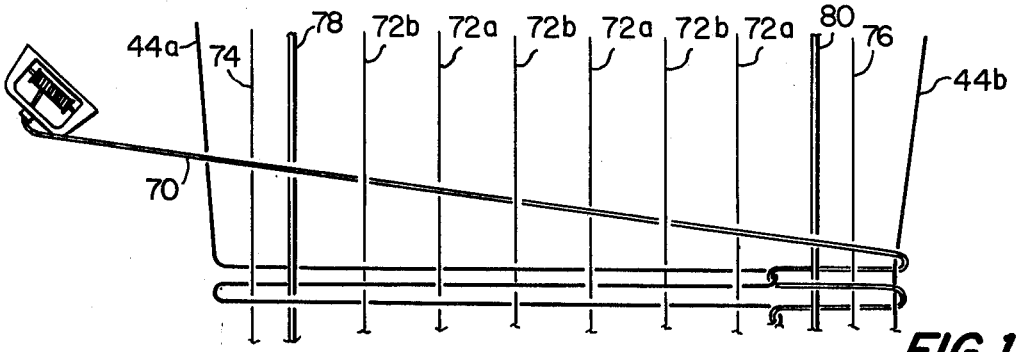

The apparatus of the present invention is now controlled so as to permit shuttle 68 to move from right to left and loop around first catch thread 44*a* and draw it into the warp. During this portion of the weaving process, as shuttle 68 moves from right to left, it is controlled to pay out shuttle thread 70 in response to tension on the shuttle thread 70 in a known manner. In FIGS. 13 A and B, shuttle thread 70 has been looped about the second edge warp threads 76 three times and shuttle 68 has passed through the warp from right to left. The first catch thread 44*a* is now raised from its lower position to its upper position by heddle 58 and dobby 26, to overpay catch thread 44*a*. After shuttle 68 has reached its left limit of travel, the appropriate harness 28 is raised by dobby 24 to in turn raise wire 80, catch thread 44*b* and the second edge warp threads 76 to their upper position. As shuttle 68 travels through the warp again from left to right, it clamps the shuttle thread 70 as before and shuttle thread 70 will loop around the first catch thread 44*a* and draw it across the warp until it is locked in position against wire 80 and second edge warp threads 76. This action is depicted in FIGS. 14 A and B. As before, shuttle thread 70 and catch thread 44*a* are then combed into the weave by the combing device 34.

Thus, by means of the novel method and appartus of the present invention, it is possible to weave a fabric having an alternating color pattern along both edges without resorting to the use of dyes. A simple example of what such a fabric would look like is shown in FIG. 15 with the first shuttle thread loops formimg a pattern of a specific color as shown at 84 and the second shuttle thread loops forming a similar pattern on the opposite edge of the fabric as shown at 88.

Although throughout the specification and drawings the edge patterns 84 and 88 have been illustrated as extending across only a small portion of the fabric width, it should be understood that this has been done for purposes of illustration only. In practice, there is a complete range of alternatives available to the fabric designer when weaving an edge pattern with the apparatus and method of the present invention. By merely repositioning wires 78 and 80 (shown in FIG. 3) and adjusting the timing of dobby 26, it is possible to extend a given edge pattern across a range of distances of from 1 to 99 percent of the fabric width. Thus, the edge pattern may even overlap in the center portion of the fabric. The only limitation of a pattern woven by the apparatus and method of the present invention is that it must extend from the edges of the fabric.

FIG. 16 shows a simple program for controlling the weaving apparatus of the present invention in order to form the weave illustrated in FIG. 3. A complete cycle comprises 17 picks and a dot in a particular box indicates that those threads are to be moved or shedded during that pick of the shuttle. It is to be understood, of course, that since the timing of dobby 26 is offset with respect to the timing of dobby 24, that the shedding of the catch threads 44*a* and 44*b* will lead the shedding of the remaining threads by a fixed amount in time. The crossing or interweaving of the shuttle thread 70 is during pick 9 wherein the second dobby 26 is not activated to pay any catch thread.

Thus, a novel apparatus and method have been provided for weaving a narrow fabric having various edge patterns woven into the fabric. The method is relatively simple and provides a great cost saving over methods which have heretofore been practiced for accomplishing the same ends. In addition, existing shuttle looms need only be slightly modified to convert them to the apparatus of the present invention. All that is required is that a second dobby be set with slightly offset timing with respect to the first dobby and the shuttle. This can be easily accomplished in a matter of minutes by any trained technician by merely loosening the drive chain on the second dobby and manually cranking it out of position the desired amount. Additionally, a filling holder must be added to the top of the loom to hold the catch threads. In lieu of a second dobby, the over pay of the catch thread can be accomplished by any programmable device which moves a single catch thread for a fixed number of cycles, which moves neither catch thread during crossover of the shuttle thread to weave from the other side and which moves the other catch thread for a fixed number of cycles.

Although the invention has been described and illustrated in detail, it is to be clearly understood that the same is by way of illustration and example only and is not to be taken by way of limitation, the spirit and scope of this invention being limited only by the terms of the appended claims.

What is claimed is:

1. A weaving apparatus for weaving a narrow fabric having a plurality of warp threads interwoven with a pair of catch threads and a shuttle thread comprising:

means positioning said warp threads between said pair of catch threads;

shed change means for raising and lowering said warp threads and said catch threads periodically at a first and second set of points in time in a cycle to weave;

shuttle means for carrying said shuttle thread through the warp threads to engage a catch thread and carry said catch thread into the warp threads; and pay means for programmably paying out not more than the single catch thread engaged by said shuttle thread during a single cycle of said shed change means.

2. A weaving apparatus as set forth in claim 1 wherein said pay means is programmed to pay one of said catch threads for a predetermined number of cycles and to then pay out the other catch thread for said predetermined number of cycles.

3. A weaving apparatus as set forth in claim 2 wherein pay means is programmed to pay out neither of said catch threads for a cycle between switching catch threads.

4. A weaving apparatus as set forth in claim 1 wherein said pay means is programmed to lead said first set of points in time to determine the amount of catch thread payed out.

5. A weaving apparatus as set forth in claim 1 wherein said shed change means and said pay means comprise first and second double index dobbies, and the timing of said second dobby leads the timing of said first dobby.

6. A weaving appartus as set forth in claim 5 wherein the degree of lead of the timing of said second dobby with respect to the timing of said first dobby is between 1° and 60° of a 360° cycle.

7. A weaving apparatus as set forth in claim 1 further including a pair of slackner heddles connected to said pay means and positioned to individually raise or lower said catch threads, and including a disc-type tension device for each catch thread.

8. A weaving apparatus as set forth in claim 1 wherein said shed change means includes first means for raising and lowering a first edge warp, second means for raising and lowering a second edge warp and third means for reversing all warp threads, either said first or said second means are activated periodically at said first points in time and said third means is activated at said second set of points in time.

9. A weaving apparatus as set forth in claim 8 wherein said first set of points in time at approximately 180° of a 360° cycle, said pay means leads said first set of points in time by between 1° and 60°, and said second set of points in time are at approximately 360°.

10. A weaving apparatus as set forth in claim 1 wherein said pay means comprises a dobby, and said shuttle means pays out shuttle thread in one direction and draws one of said catch threads into said warp threads in the opposite direction, said dobby reversing the motion of said one catch thread before being drawn in by said shuttle thread.

* * * * *

UNITED STATES PATENT AND TRADEMARK OFFICE

CERTIFICATE OF CORRECTION

PATENT NO. : 4,077,437

DATED : Mar. 7, 1978

INVENTOR(S) : Spence, Rorrer and Holt

It is certified that error appears in the above-identified patent and that said Letters Patent are hereby corrected as shown below:

Claim 2, line 2, after "pay" (second occurrence) insert -- out --.

Claim 3, line 2, after "wherein" insert -- said --.

Claim 9, line 2, after "time" insert -- are --.

Claim 10, line 6, delete "motion" and insert therefor -- position --.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*